United States Patent [19]

Ramaswamy

[11] Patent Number: 5,019,192

[45] Date of Patent: May 28, 1991

[54] PRIMARY/DETONATOR COMPOSITIONS SUITABLE FOR USE IN ALUMINUM CUPS

[75] Inventor: Coodly P. Ramaswamy, Christiana, Pa.

[73] Assignee: Breed Automotive Technology, Inc., Boonton Township,, N.J.

[21] Appl. No.: 593,853

[22] Filed: Oct. 5, 1990

[51] Int. Cl.[5] ..... C06B 33/06

[52] U.S. Cl. ..... 149/42; 149/77; 149/82

[58] Field of Search ..... 149/42, 77, 82

[56] References Cited

U.S. PATENT DOCUMENTS

| | | | |
|---|---|---|---|
| 3,904,451 | 9/1975 | Rainone | 149/85 |
| 4,566,921 | 1/1986 | Dugvet | 149/77 |
| 4,963,201 | 10/1990 | Bjerke et al. | 149/2 |

*Primary Examiner*—Stephen J. Lechert, Jr.

*Attorney, Agent, or Firm*—Kane, Dalsimer, Sullivan, Kurucz, Levy, Eisele and Richard

[57] ABSTRACT

The invention is directed to a primary/detonator composition suitable for use in an automobile airbag system. The composition may safely be housed in aluminum support structures (a/k/a cups).

4 Claims, No Drawings

PRIMARY/DETONATOR COMPOSITIONS SUITABLE FOR USE IN ALUMINUM CUPS

FIELD OF THE INVENTION

The invention is directed to a primary/detonator composition suitable for use in an automobile airbag system. The composition may safely be housed in aluminum support structures (a/k/a cups).

BACKGROUND OF THE INVENTION

Primers, or detonators as they are alternatively known, are the means used to detonate an explosive charge. Those devices may be detonated by electrical or purely mechanical means. They are comprised of a primary explosive which may be initiated by stab, friction or impact, an intermediate explosive composition that is set off by the primer composition, and a base charge of a secondary explosive such as RDX or HMX to provide the desired explosive output. These primers ordinarily coupled with booster charges and a propellant to form an explodable ignition chain.

Primer/detonator compositions are employed in a variety of applications, including weapon systems, razing buildings, and in creating excavations. Primer/-detonators are also used to initiate the explosive chain in automobile air bag systems. Explosive charges are uniquely suited for these systems because the explosive reaction instantaneously generates a large volume of gas that fills the air bag. It is essential that the air bag be filled within that instant between collision and the occupant's impact with the dashboard.

As the primer/detonator functions to initiate the explosive reaction, the primer must possess some means for igniting the chain. This is the function of the sensitizer, which may be in either electrical or mechanical form.

Airbag systems are ordinarily housed in a metallic structure. As it is desirable from an engineering and design standpoint to choose the lightest materials available, aluminum is the material of choice for housing.

SUMMARY OF THE INVENTION

It is an object of the invention to provide primer/-detonator compositions compatible for use with aluminum cups.

It is a further object of the invention to develop chemical sensitizers which are an alternatives to tetracene.

The present inventions discloses two primer detonator compositions comprised of antimony sulfide, potassium chlorate, zirconium, and utilize either lead ferrocyanide or lead thiocyanide as the sensitizer. It is notable that lead ferrocyanide has never been utilized in primer compositions as a sensitizer.

The following composition is disclosed and can be safely used within an aluminum cup:

| | % |
|---|---|
| Antimony Sulfide | 55.5 |
| Potassium Chlorate | 37.5 |
| Zirconium | 2.0 |
| Lead Ferrocyanide | 5.0 |

Lead ferrocyanide is used as a chemical sensitizer. Heretofore, lead ferrocyanide has never been used in this capacity.

A second formulation suitable for use with aluminum cups makes use of lead thiocyanate as the sensitizer is set forth below.

| | % |
|---|---|
| Antimony Sulfide | 55.5 |
| Potassium Chlorate | 37.5 |
| Zirconium | 2.0 |
| Lead Thiocyanate | 5.0 |

I claim:

1. A primer/detonator composition housed in an aluminum cup comprised of the following: antimony sulfide, potassium chlorate, zirconium and lead ferrocyanide.

2. A primer/detonator as set forth in claim 1 wherein the following composition is utilized:

| | % |
|---|---|
| Antimony Sulfide | 55.5 |
| Potassium Chlorate | 37.5 |
| Zirconium | 2.0 |
| Lead Ferrocyanide | 5.0 |

3. A primer/detonator composition housed in an aluminum cup comprised of antimony sulfide, potassium chlorate, zirconium and lead thiocyanate.

4. A primer/detonator as set forth in claim 3 wherein the components comprise the following compositions:

| | % |
|---|---|
| Antimony Sulfide | 55.5 |
| Potassium Chlorate | 37.5 |
| Zirconium | 2.0 |
| Lead Thiocyanate | 5.0 |

* * * * *